US010014137B2

(12) United States Patent
Willis

(10) Patent No.: US 10,014,137 B2
(45) Date of Patent: Jul. 3, 2018

(54) ACOUSTICAL ELECTRICAL SWITCH

(71) Applicant: AT&T Intellectual Property I, L.P., Atlanta, GA (US)

(72) Inventor: John Willis, Plano, TX (US)

(73) Assignee: AT&T INTELLECTUAL PROPERTY I, L.P., Atlanta, GA (US)

( * ) Notice: Subject to any disclaimer, the term of this patent is extended or adjusted under 35 U.S.C. 154(b) by 0 days.

(21) Appl. No.: 14/874,384

(22) Filed: Oct. 3, 2015

(65) Prior Publication Data

US 2017/0098517 A1 Apr. 6, 2017

(51) Int. Cl.
*H04R 3/00* (2006.01)
*H01H 21/04* (2006.01)

(52) U.S. Cl.
CPC ..... *H01H 21/04* (2013.01); *H01H 2221/022* (2013.01)

(58) Field of Classification Search
CPC ..... H04R 2201/405; H04R 2225/55; H04R 2307/027; H04R 2410/07; H04R 2460/03; H04R 25/00; H04R 25/02; H04R 25/43; H04R 25/556; H04R 27/00; H04R 3/00; H04R 5/023; H04R 1/1041; H04R 1/34; H04R 1/40; H04R 1/023; G10K 11/22; G10K 11/26; G10K 15/10; H04B 11/00; H04B 1/0346; H04B 1/3833; H04B 1/385; H04B 1/44; H04B 2001/3861; H04B 5/0093; H04B 5/06; H04L 12/2838; H04L 2012/2849; H04S 3/002
USPC ..... 381/122, 123, 92; 700/94; 455/569, 416
See application file for complete search history.

(56) References Cited

U.S. PATENT DOCUMENTS

| | | | | |
|---|---|---|---|---|
| 4,854,885 | A | 8/1989 | Bowden, Jr. et al. | |
| 5,384,838 | A | 1/1995 | Hoffman | |
| 5,493,618 | A | 2/1996 | Stevens et al. | |
| 5,871,086 | A | 2/1999 | Bachschmid | |
| 5,889,871 | A | 3/1999 | Downs, Jr. | |
| 5,914,826 | A | 6/1999 | Smallwood | |
| 6,087,588 | A * | 7/2000 | Soules | H01H 9/185 174/66 |
| 7,022,931 | B2 | 4/2006 | Shimoda et al. | |
| 7,139,716 | B1 | 11/2006 | Gaziz | |
| 7,761,555 | B1 * | 7/2010 | Bishel | H04L 12/2814 340/12.39 |
| 7,997,925 | B2 | 8/2011 | Lam et al. | |
| 9,147,398 | B2 | 9/2015 | White | |
| 9,704,489 | B2 | 7/2017 | Haider | |

(Continued)

FOREIGN PATENT DOCUMENTS

| | | |
|---|---|---|
| EP | 994536 A1 | 10/1990 |
| GB | 2410137 | 1/2004 |

*Primary Examiner* — Lun-See Lao
(74) *Attorney, Agent, or Firm* — Scott P. Zimmerman, PLLC

(57) ABSTRACT

An electrical switch responds to acoustic inputs. A microphone integrated into the electrical switch generates electrical signals in response to the acoustic inputs. A network interface integrated into the electrical switch provides addressable communication with controllers, computers, and other networked devices. The electrical switch may thus be installed or retrofitted into the electrical wiring of all homes and businesses. Users may thus speak voice commands, which are received by the electrical switch and sent for voice control of appliances and other automation tasks.

13 Claims, 23 Drawing Sheets

(56) References Cited

U.S. PATENT DOCUMENTS

| | | | | |
|---|---|---|---|---|
| 2003/0013503 | A1* | 1/2003 | Menard | H04M 1/0291 455/569.2 |
| 2003/0210770 | A1 | 11/2003 | Krejcarek | |
| 2006/0057873 | A1 | 3/2006 | Ortega | |
| 2007/0076904 | A1 | 4/2007 | Deruginsky | |
| 2008/0012423 | A1 | 1/2008 | Mimram | |
| 2009/0216529 | A1 | 8/2009 | Bengtsson | |
| 2009/0287485 | A1 | 11/2009 | Glebe | |
| 2011/0101793 | A1 | 5/2011 | Chang | |
| 2011/0123043 | A1 | 5/2011 | Felberer | |
| 2011/0297522 | A1 | 12/2011 | Elzing | |
| 2012/0008802 | A1 | 1/2012 | Felber | |
| 2013/0058051 | A1 | 3/2013 | Casey | |
| 2013/0244475 | A1 | 9/2013 | Sayadi | |
| 2013/0260613 | A1 | 10/2013 | Misener | |
| 2014/0334640 | A1 | 11/2014 | Chan | |
| 2015/0077555 | A1 | 3/2015 | Scalisi | |
| 2015/0086034 | A1 | 3/2015 | Lombardi et al. | |
| 2015/0108841 | A1 | 4/2015 | Weber et al. | |
| 2017/0025854 | A1 | 1/2017 | Willis | |
| 2017/0264453 | A1 | 9/2017 | Haider | |

* cited by examiner

ACOUSTICAL ELECTRICAL SWITCH

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

BACKGROUND

Intercom systems can be found in many homes and businesses. These intercom systems allow occupants in different rooms to communicate. However, conventional intercom systems rely on dedicated wiring or wireless transmission. The dedicated wiring is expensive and usually installed during construction, thus becoming quickly outdated. Conventional wireless intercoms have limited range and interference issues.

BRIEF DESCRIPTION OF THE SEVERAL VIEWS OF THE DRAWINGS

The features, aspects, and advantages of the exemplary embodiments are better understood when the following Detailed Description is read with reference to the accompanying drawings, wherein.

DETAILED DESCRIPTION

The exemplary embodiments will now be described more fully hereinafter with reference to the accompanying drawings. The exemplary embodiments may, however, be embodied in many different forms and should not be construed as limited to the embodiments set forth herein. These embodiments are provided so that this disclosure will be thorough and complete and will fully convey the exemplary embodiments to those of ordinary skill in the art. Moreover, all statements herein reciting embodiments, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating the exemplary embodiments. The functions of the various elements shown in the figures may be provided through the use of dedicated hardware as well as hardware capable of executing associated software. Those of ordinary skill in the art further understand that the exemplary hardware, software, processes, methods, and/or operating systems described herein are for illustrative purposes and, thus, are not intended to be limited to any particular named manufacturer.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

It will also be understood that, although the terms first, second, etc. may be used herein to describe various elements, these elements should not be limited by these terms. These terms are only used to distinguish one element from another. For example, a first device could be termed a second device, and, similarly, a second device could be termed a first device without departing from the teachings of the disclosure.

Figure 1:
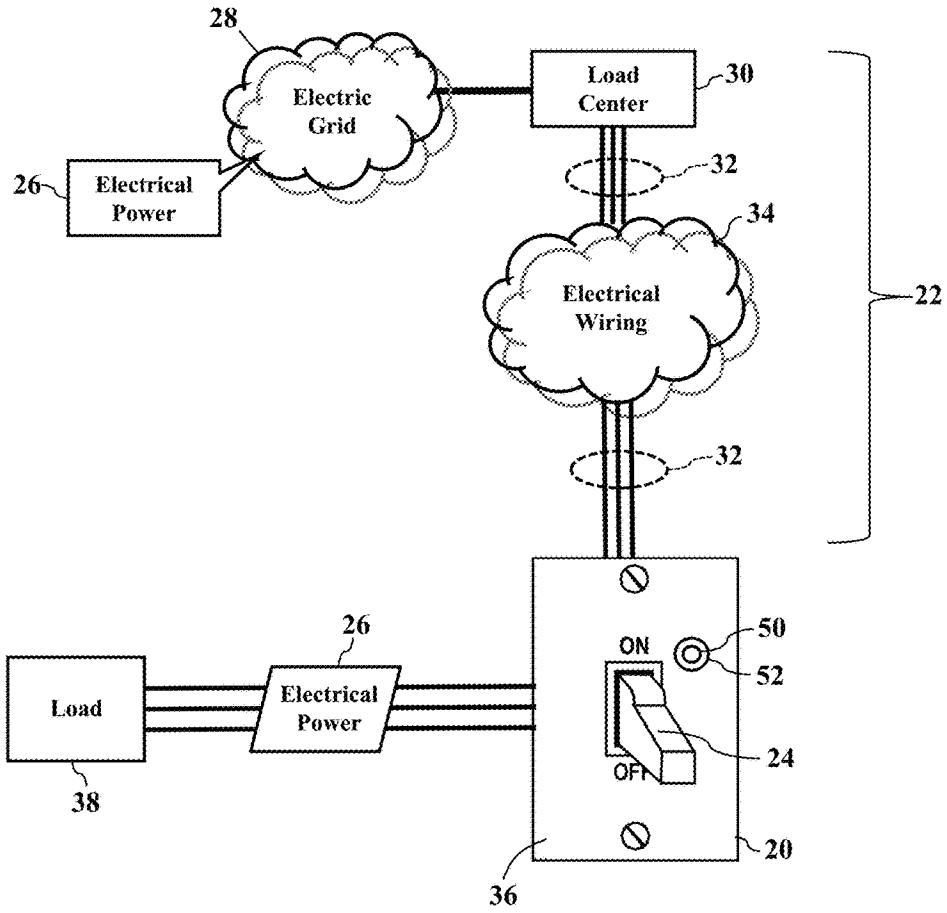
FIGS. 1-4 are simplified illustrations of an environment in which exemplary embodiments may be implemented.

FIGS. 1-4 are simplified illustrations of an environment in which exemplary embodiments may be implemented. FIG. 1 illustrates an electrical light switch 20 connected to a residential or business electrical wiring distribution system 22. The electrical light switch 20 is illustrated as having a movable rocker or toggle actuator 24, as is common in homes and businesses. As the reader understands, electrical power 26 (e.g., current and voltage) is delivered from the electric grid 28 to a load center 30 in a home or business. The load center 30 has circuit breakers (not shown) contained within a panel. Conductors 32 in electrical wiring 34 distribute the electrical power 26 to the electrical light switch 20. A wall plate 36 hides the physical connections to the conductors 32, thus providing a finished installation appearance. When the actuator 24 is in a first position, an electrical connection closes to deliver the electrical power 26 to some electrical load 38 (such as a lamp or other appliance). However, when the actuator 24 is in a second position, the electrical connection opens to stop delivery of the electrical power 26 to the electrical load 38. The electrical wiring distribution system 22 is very well known and thus need not be explained in greater detail.

Here, though, the electrical light switch 20 is acoustically responsive. That is, the electrical light switch 20 also detects sounds in the vicinity of its installed location. The electrical light switch 20 includes an acoustic transducer 50. The reader is likely familiar with a microphone, which is a common term for the acoustic transducer 50. This disclosure will thus generally refer to the acoustic transducer 50 as a microphone 52 for familiarity and ease of explanation.

Figure 2:
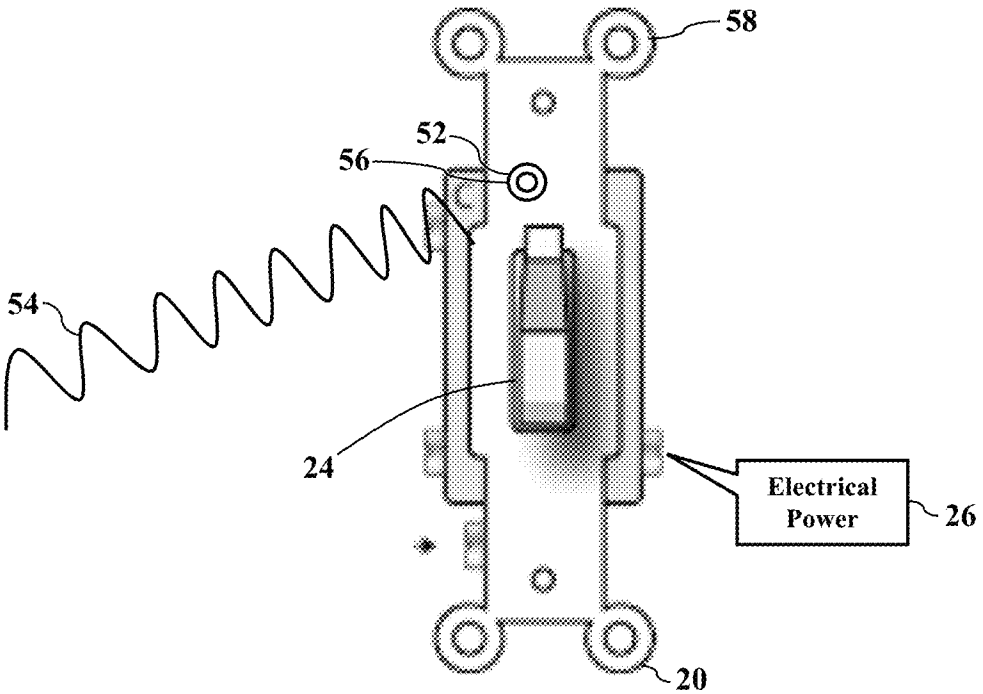

FIG. 2 better illustrates the microphone 52. The electrical light switch 20 is illustrated without the wall plate (illustrated as reference numeral 36 in FIG. 1). The microphone 52 converts sound pressure waves 54 into electrical energy and/or signals. The microphone 52 has a sensory element 56 that converts the sound pressure waves 54 into electrical signals. For clarity, FIG. 2 illustrates the sensory element 56 exposed by a front cover 58 of the electrical light switch 20. However, the sensory element 56 may have any location in or on the electrical light switch 20, as later paragraphs will explain. Regardless, the sensory element 56 responds to stimulus sounds present in the room where the electrical light switch 20 is installed. When the electrical light switch 20 is energized with the electrical power 26 (from the conductors 32, as FIG. 1 illustrated), the electrical power 26 is also supplied to the microphone 52. The electrical power 26 thus causes the microphone 52 to convert the sound pressure waves 54 into electrical energy.

Figure 3:
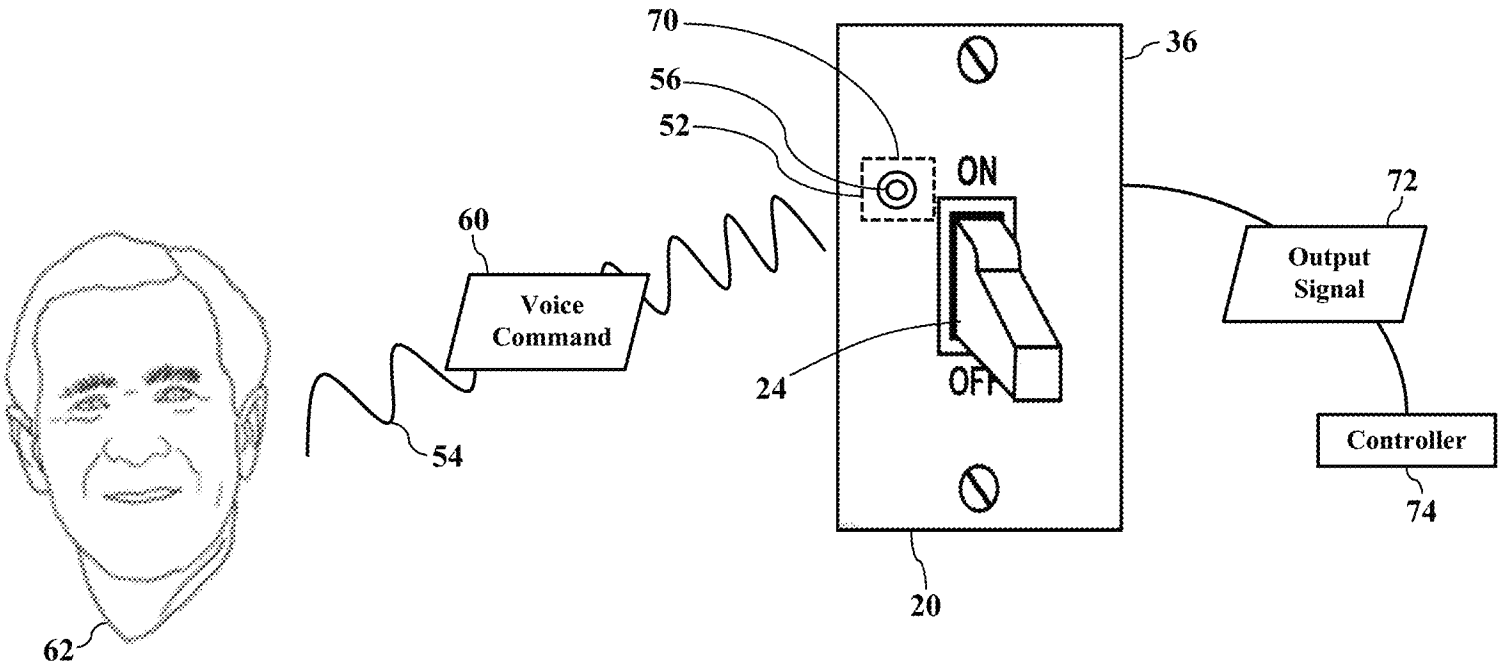

As FIG. 3 illustrates, the electrical light switch 20 may thus respond to audible commands 60. When the electrical light switch 20 is installed in a conventional electrical outlet box (not shown), the wall plate 36 hides some of the electrical light switch 20 within or behind drywall sheetrock, paneling, or other stud and insulation covering. However, the sensory element 56 remain exposed. The microphone 52 thus detects audible words and phrases spoken by a user 62 when in the vicinity or proximity of the electrical light switch 20. The user's audible speech (mechanically represented as the sound pressure waves 54) propagates to the microphone 52. The user's audible speech is thus converted to electrical energy by microphone circuitry 70, which will be later explained. The microphone circuitry 70 thus generates an output signal 72 that is representative of the sound pressure waves 54. The output signal 72 may thus be sent or conveyed to a controller 74 for interpretation and action. The user may thus speak the voice commands 60 to control appliances, lights, and other automation systems.

Figure 4:
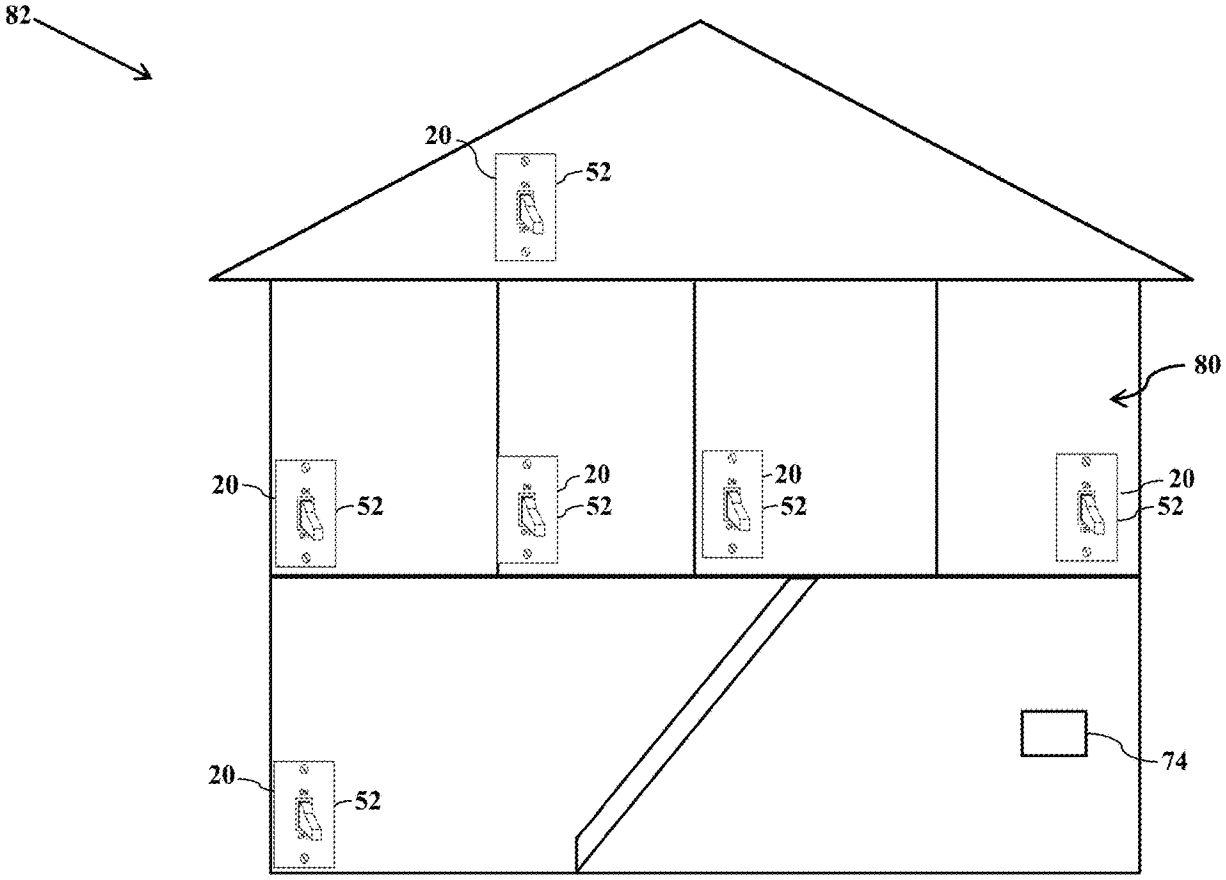

FIG. 4 illustrates a whole-home installation. Here one or more of the electrical light switches 20 may be installed in each room 80 of a home 82. The electrical light switch 20 may thus be deployed or installed in a bedroom, a living room, and a bathroom, thus allowing voice control throughout the home 80. The electrical light switch 20, of course, may similarly be installed within the rooms of an office or any other facility. The controller 74 may thus respond to voice commands spoken throughout an area having electrical service. The microphone 52, integrated with the electrical light switch 20, may also detect the speech of multiple users in the same room, thus allowing the controller 74 to distinguish and execute different commands spoken within the room.

Exemplary embodiments thus enhance the digital home experience. As more people learn about the benefits and conveniences of home control and automation, the cost and difficulty of installation may be an obstacle to wide adoption. Exemplary embodiments thus provide a simple solution that meshes with the existing electrical wiring distribution system 22 already used by nearly all homes and businesses. No extra wiring is required, and no installation concerns are added. Moreover, exemplary embodiments retain the conventional movable actuator 24, thus promoting familiar and widespread adoption. Exemplary embodiments thus present an elegant solution for enhancing verbal communication and control in interior and outside environments.

FIGS. 5-8 are more detailed illustrations of the electrical light switch 20, according to exemplary embodiments. Many of the components of the electrical light switch 20 are well known, so the conventional componentry need only be briefly explained. For example, the electrical light switch 20 has the front cover 58 that mates to, or aligns with, a housing 90 to form an electrical enclosure 92. Retained within the electrical enclosure 92 is a mechanical switch assembly 94. Movement of the lever actuator 24 selectively couples or decouples two or more terminal poles or screws 96 and 98. Again, the internal componentry of the electrical light switch 20 is well known and need not be further explained.

Figure 5:
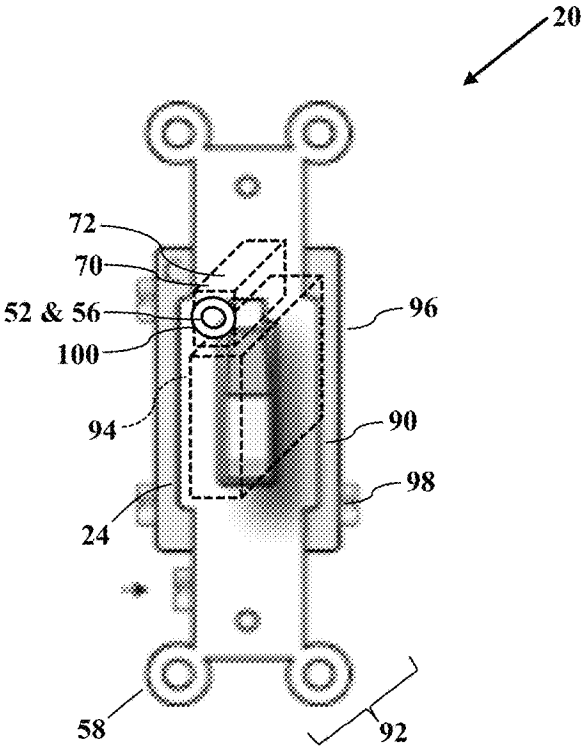
FIGS. 5-8 are more detailed illustrations of an electrical light switch, according to exemplary embodiments.

The electrical light switch 20 may also include the microphone 52. FIG. 5 illustrates the microphone 52 mostly or substantially housed within the electrical enclosure 92 formed by the cover 58 and the housing 90. Even though the microphone 52 and the microphone circuitry 70 may be enclosed within the electrical enclosure 92, an acoustic aperture 100 in the cover 58 exposes the sensory element 56 to ambient sounds (such as the sound pressure waves 54 illustrated in FIGS. 2-3). That is, even though the microphone circuitry 70 may be enclosed within and protected by the electrical enclosure 92, the acoustic aperture 100 allows the sensory element 56 to receive or to detect the sound pressure waves 54. The microphone circuitry 70 thus generates the output signals 72 in response to the stimulus sound pressure waves 54.

Figure 6:
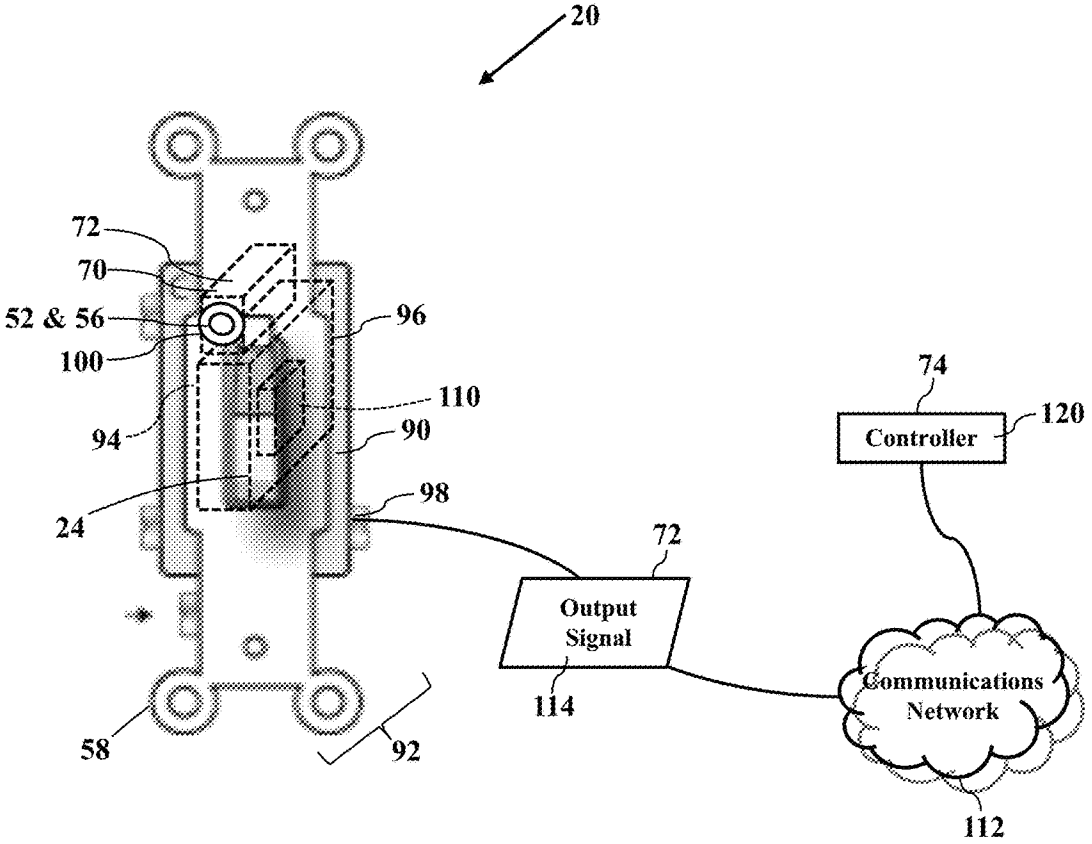
Figure 7:
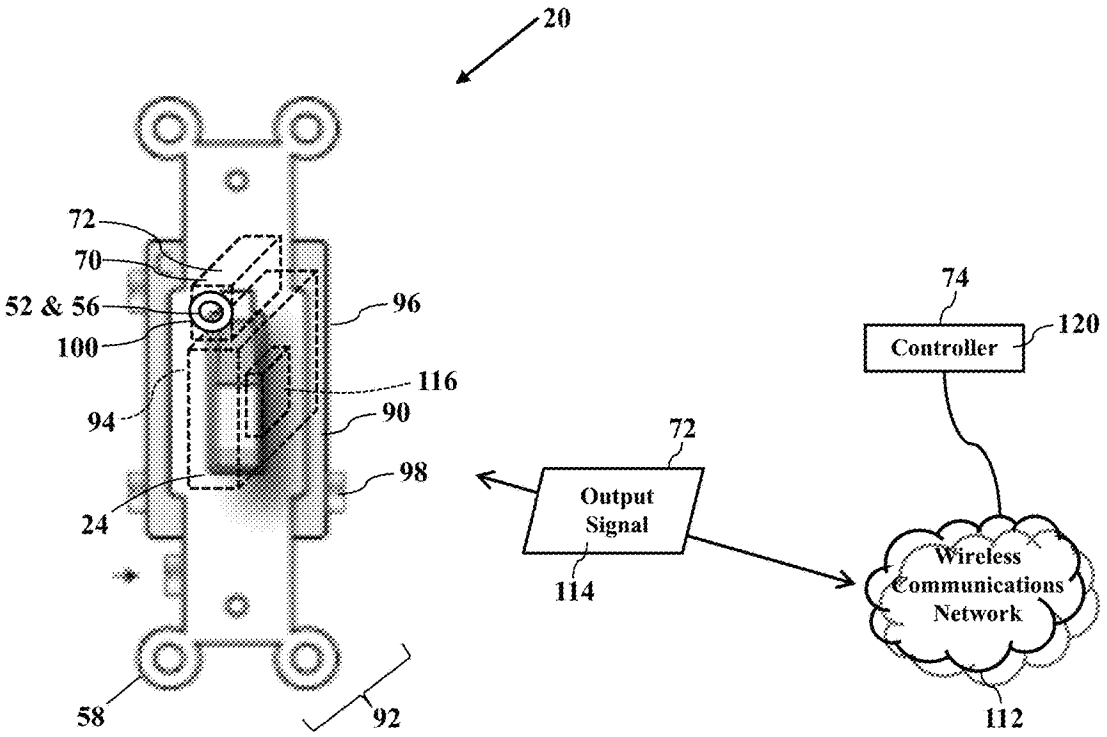
Figure 8:
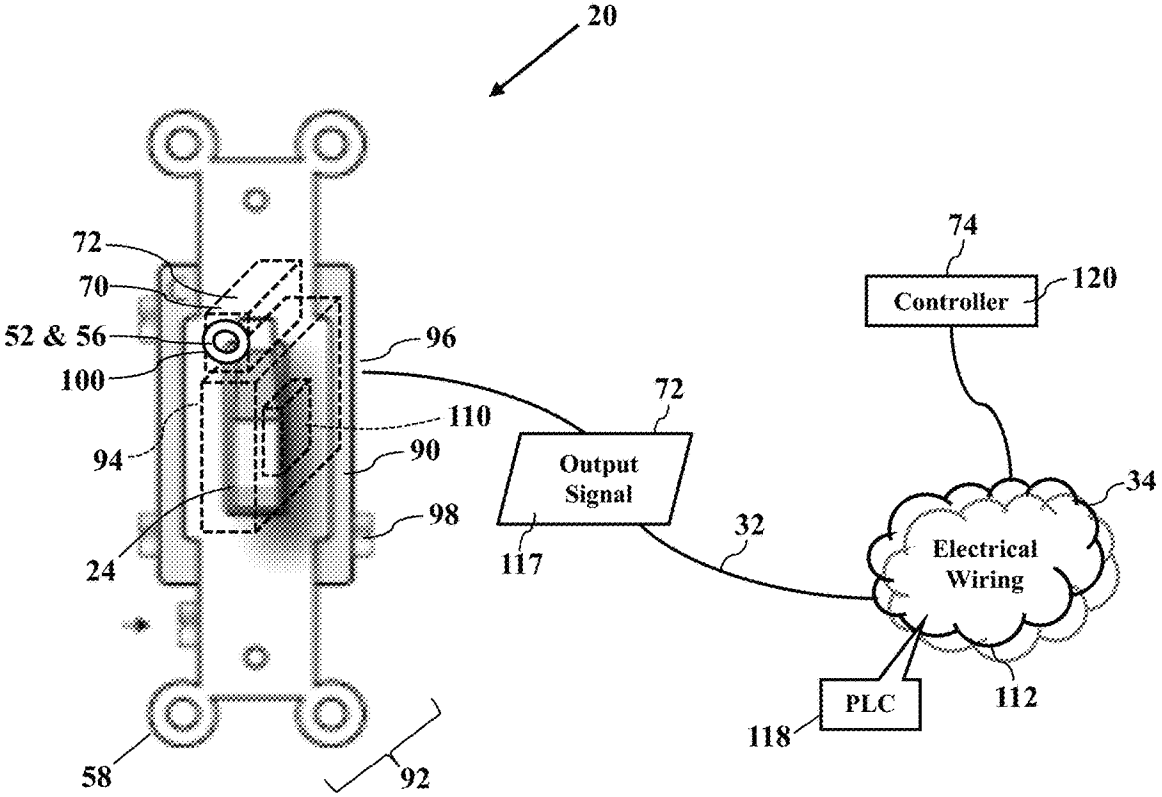

FIGS. 6-8 illustrate a network interface 110. The network interface 110 may also be mostly, substantially, or entirely housed within the electrical enclosure 92 formed by the cover 58 and the housing 90. When the microphone circuitry 70 generates the output signals 72, the output signals 72 are received by the network interface 110. The network interface 110 interconnects the electrical receptacle 20 to a communications network 112. The network interface 110 thus prepares or processes the output signals 72 according to a protocol 114. FIG. 7, for example, illustrates the network interface 110 having wireless capabilities according to a wireless protocol 114. A transceiver 116 may also be housed within the electrical enclosure 92 formed by the cover 58 and the housing 90. The transceiver 116 may thus wirelessly transmit the output signals 72 as a wireless signal via the wireless communications network 112. FIG. 8, though, illustrates the network interface 110 implementing a packetized Internet Protocol 117 and/or a power line communications (or "PLC") protocol 118 that modulates the output signal 72 onto the conductors 32 of the electrical wiring 34. Exemplary embodiments, though, may utilize any hardware or software network interface. The network interface 110 thus sends data or information representing the output signals 72 as messages or signals to any destination, such as the network address 120 associated with the controller 74. The controller 74 thus interprets the output signals 72 for voice recognition and/or automated control.

Figure 9:
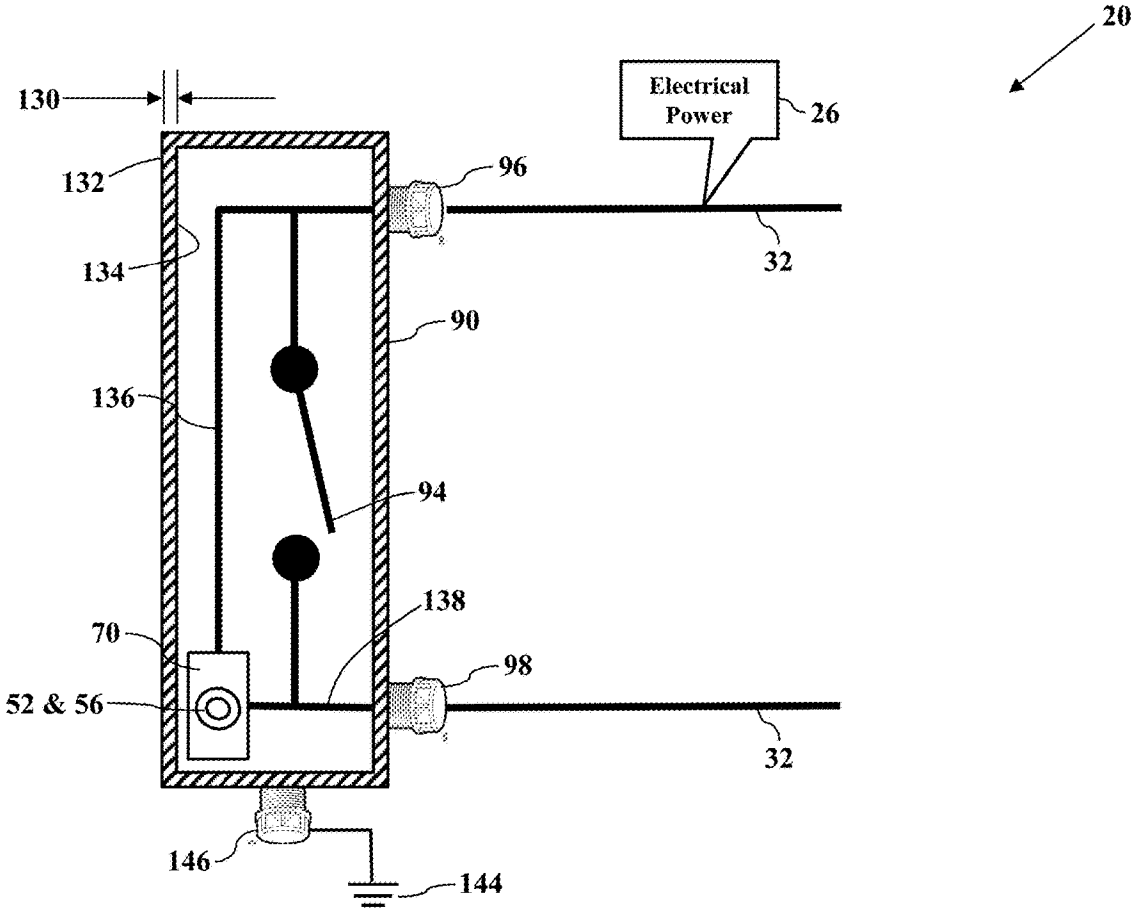
FIGS. 9-11 are sectional views of a housing, according to exemplary embodiments.
Figure 10:
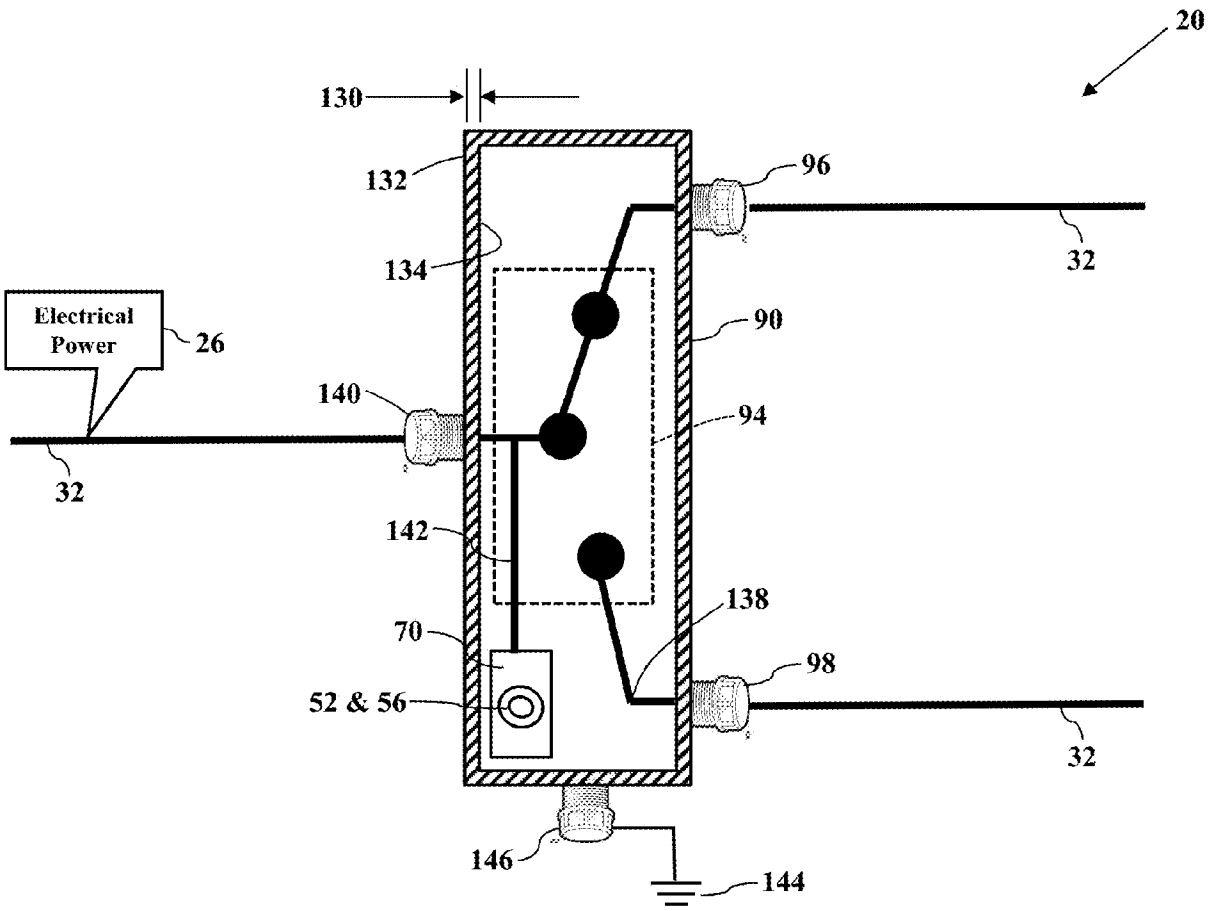
Figure 11:
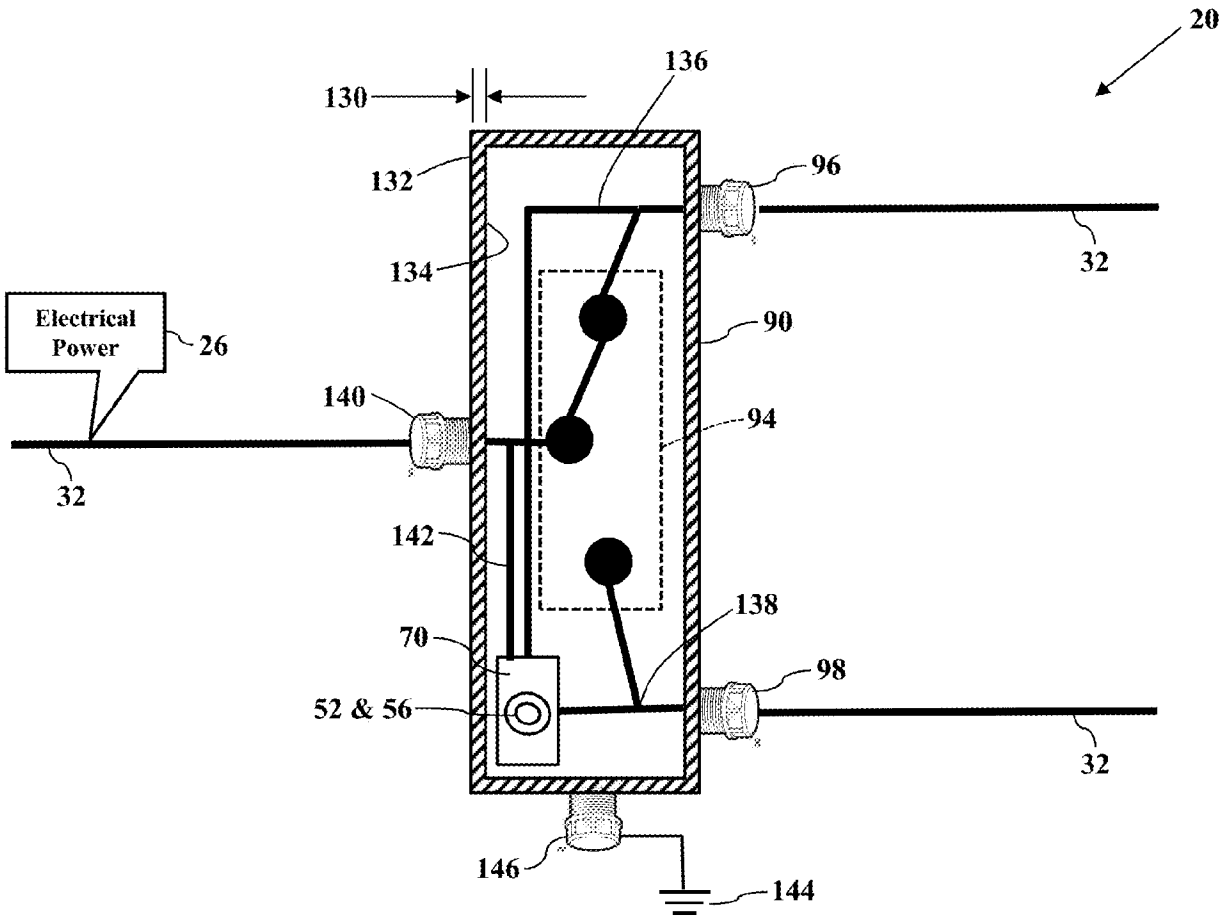

FIGS. 9-11 are sectional views of the housing 90, according to exemplary embodiments. The housing 90 has a material thickness 130 defined by an outer surface 132 and an inner surface 134. The housing 90 may thus have a generally hollow interior region that retains the internal switch assembly 94 therein (except the toggle actuator 24 protruding therethrough). Here, though, the microphone circuitry 70 may have a constant electrical connection to the electrical power 26 provided by at least one of the terminal screws or poles 96 and 98. FIG. 9, for example, illustrates the internal switch assembly 94 that selectively connects and disconnects the electrical connection between the terminal screws or poles 96 and 98. In other words, when the internal switch assembly 94 is closed, the electrical power 26 is provided to both terminal screws 96 and 98. However, when the internal switch assembly 94 is open, the electrical power 26 is only provided to one of the terminal screws 96 or 98. One of the terminal screws 96 or 98 is thus electrically disconnected in an "off" position. Only one of the terminal screws 96 or 98 is always live or hot, regardless of a position (open/closed) of the internal switch assembly 94. Exemplary embodiments may thus establish electrical connections 136 and 138 with both terminal screws 96 and 98. These electrical connections 136 and 138, though, are electrically separate from the electrical connections between the internal switch assembly 94 and the terminal screws 96 and 98. The microphone circuitry 70 may thus always receive the electrical power 26, regardless of which terminal screw 96 or 98 is hot and regardless of the position (on/off or open/closed) of the internal switch assembly 94. The microphone circuitry 70 may thus have multiple power inputs to ensure the electrical power 26 is continually received, regardless of which terminal screw 96 or 98 is hot.

FIG. 10 illustrates a three-way configuration. Here the internal switch assembly 94 switches electrical connection between either of the terminal screws 96 or 98 and a third terminal screw 140. The third terminal screw 140, in other words, is always hot and receiving the electrical power 26. The microphone circuitry 70 may thus have a single parallel electrical connection 142 to the third terminal screw 140 that always receives the electrical power 26.

FIG. 11 further illustrates the three-way configuration. Here again the internal switch assembly 94 switches electrical connection between either of the terminal screws 96 or 98 and the third terminal screw 140. Even though the third terminal screw 140 is generally hot, there will be a momentary loss of the electrical power 26 during movement of the internal switch assembly 94. That is, as the internal switch assembly 94 switches electrical connection from the first terminal screw 96 to the second terminal screw 98, electrical connection with the third terminal screw 140 is lost during mechanical movement (such as the toggle actuator 24 illustrated in FIG. 1). This momentary loss of the electrical power 26 may be detrimental to the microphone circuitry 70, perhaps even inducing premature circuitry failures. FIG. 11 thus illustrates the microphone circuitry 70 having multiple power inputs with each one of the terminal screws 96, 98, and 140. That is, the microphone circuitry 70 may have the three (3) respective electrical connections 136, 138, and 142 with each one of the terminal screws 96, 98, and 140. These multiple power inputs may be electrically separate and isolated from the electrical connections between the internal switch assembly 94 and the terminal screws 96, 98, and 140. The microphone circuitry 70 may thus always receive the 120 Volt electrical power 26, regardless of which terminal screws 96, 98, and/or 140 are hot and regardless of momentary disconnections during movement of the internal switch assembly 94.

FIGS. 9-11 also illustrate electrical ground 144. Because the electrical light switch 20 is physically connected to the conductors 32 of the electrical wiring 34 (as FIG. 1 illustrates), the electrical light switch 20 may have an available physical connection to one of the conductors 32 providing the electrical ground 144. The electrical light switch 20 may thus have another pole or terminal screw 146 for connection to the electrical ground 144. The microphone circuitry 70 may thus have a separate or common connection to the electrical ground 144.

Figure 12:
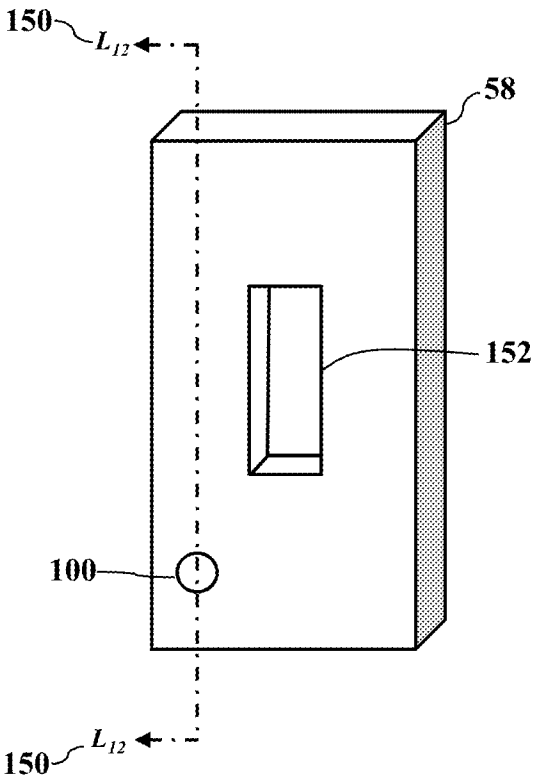
FIGS. 12-17 are illustrations of a cover, according to exemplary embodiments.
Figure 13:
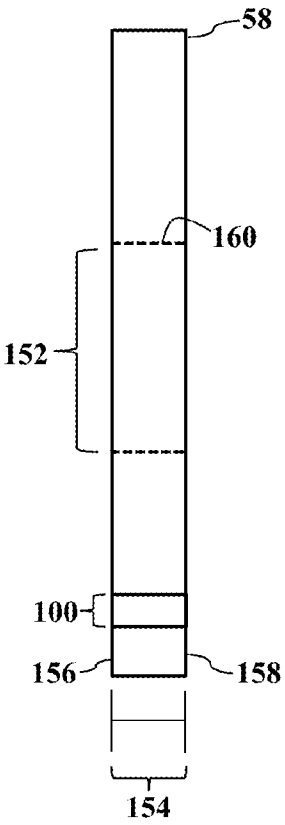
Figure 14:
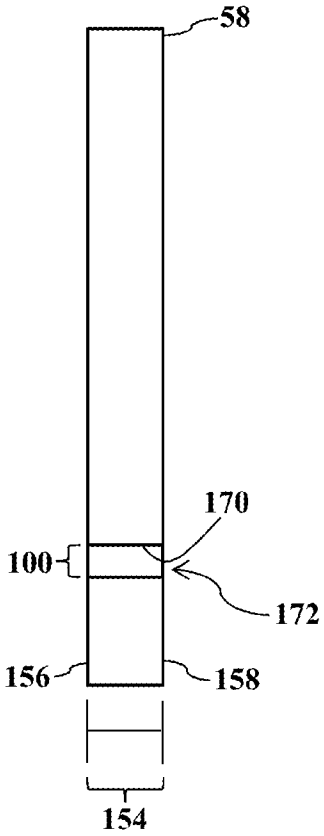

FIGS. 12-17 are more illustrations of the cover 58, according to exemplary embodiments. FIG. 12 illustrates a front view of the cover 58, while FIGS. 13-14 illustrate sectional views of the cover 58 taken along line $L_{12}$ (illustrated as reference numeral 150) of FIG. 12. The sectional views are enlarged for clarity of features. The cover 58 has a central aperture 152 through which the toggle actuator (illustrated as reference numeral 24 in FIGS. 1-3) extends for manual movement, as the reader understands. FIG. 13 illustrates the aperture 152 in a hidden view, while FIG. 14 only illustrates the acoustic aperture 100. The cover 58 may have any shape and size to suit different configurations and needs. FIGS. 12-14 thus illustrate the cover 58 having a simple rectangular shape. The cover 58 has the material thickness 154 defined by an outer surface 156 and an inner surface 158. The aperture 152 has a corresponding wall 160 defining an interior opening or material void having the general shape of the toggle actuator 24 that inserts therethrough (as FIGS. 1-3 illustrated). As FIG. 14 best illustrates, the acoustic aperture 100 has an inner wall 170 defining a cross-sectional area 172. While the acoustic aperture 100 may have any cross-sectional shape, this disclosure mainly illustrates a simple circular cross-sectional shape with the circumferential inner wall 170 defining a circular hole, passage, or inlet. The acoustic aperture 100 may thus extend through the material thickness 154 from the inner surface 158 to the outer surface 156.

Figure 15:
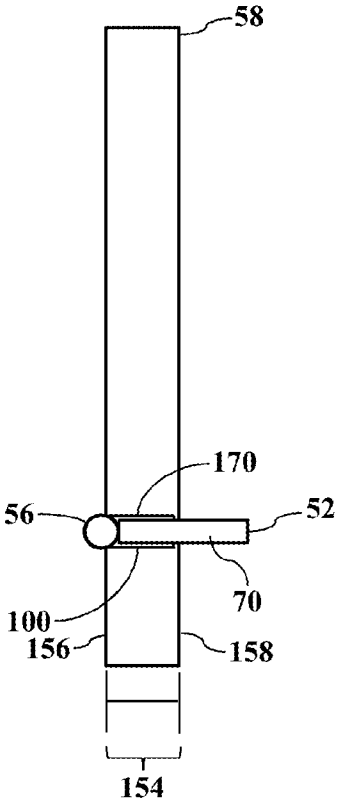
Figure 16:
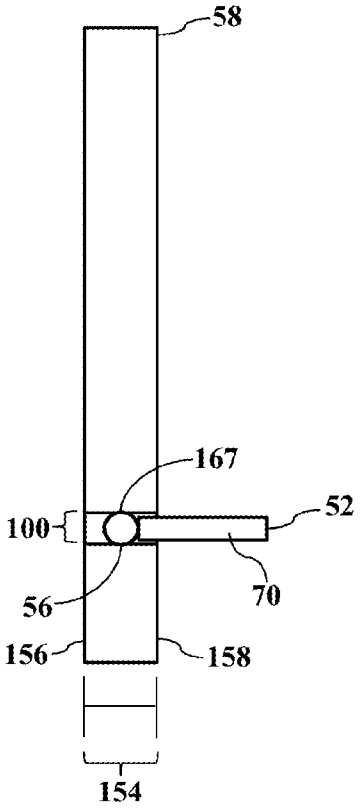
Figure 17:
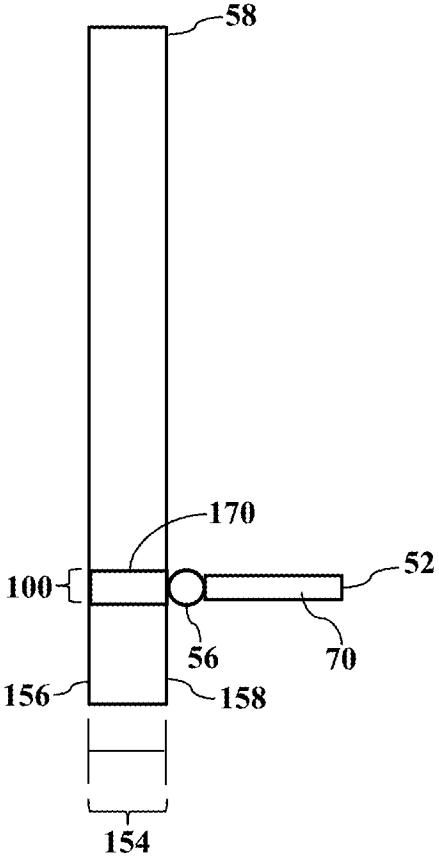

FIGS. 15-17 illustrate different positions of the sensory element 56. FIG. 15, for example, illustrates the sensory element 56 sized for insertion into and through the acoustic aperture 100. The sensory element 56 may thus outwardly extend beyond the outer surface 156 of the cover 58 to detect propagating sounds. The remaining componentry of the microphone 52 (such as the microphone circuitry 70) may be located elsewhere, as desired or needed. FIG. 16, though, illustrates the sensory element 56 arranged or aligned within the acoustic aperture 100, but the sensory element 56 may not outwardly extend beyond the outer surface 156 of the cover 58. The sensory element 56, in other words, may be positioned between the inner surface 158 and the outer surface 156 of the cover 58. FIG. 17 illustrates the sensory element 56 arranged or aligned with the acoustic aperture 100, but the sensory element 56 may not extend past the inner surface 158 of the cover 58. The sensory element 56 may thus be protected from damage beyond the outer surface 156 of the cover 58, but the acoustic aperture 100 guides the sound pressure waves 54 to the sensory element 56. The acoustic aperture 100 may thus be an acoustic waveguide that reflects and directs the sound pressure waves 54 to the sensory element 56.

Figure 18:
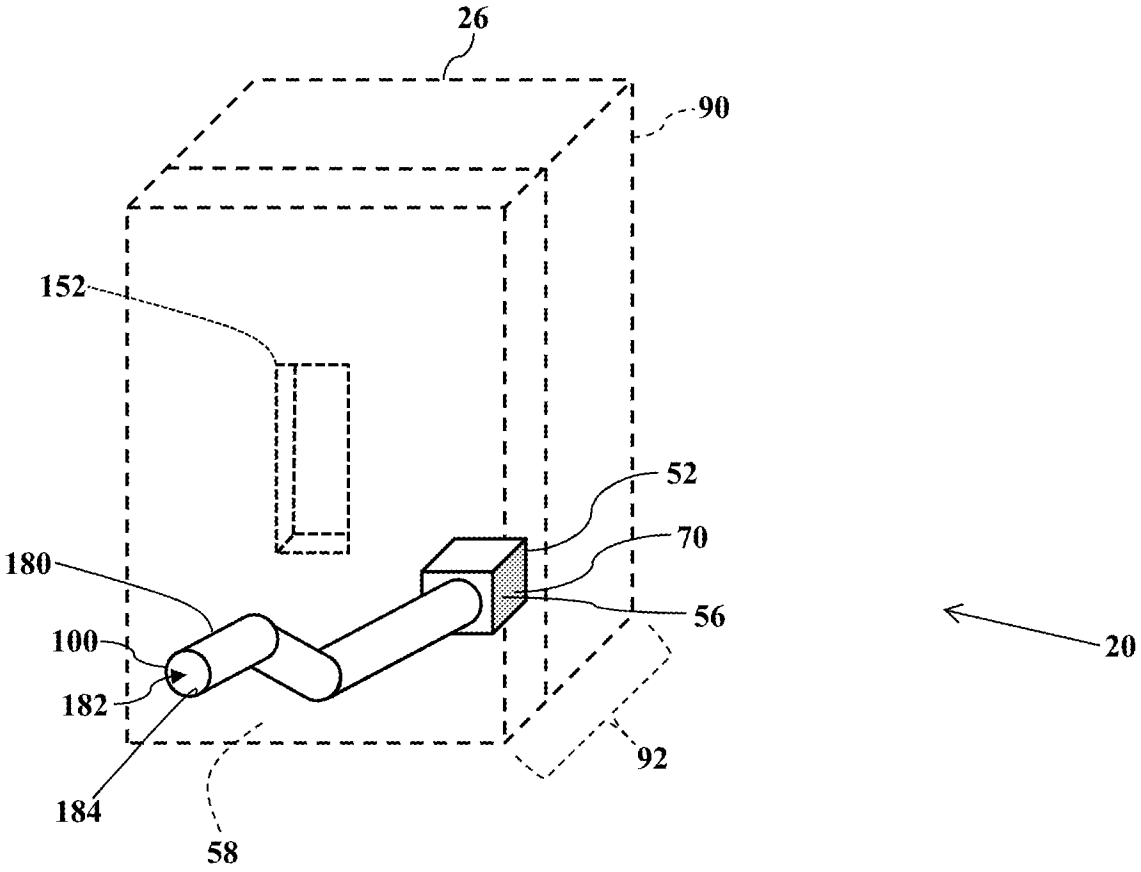
FIG. 18 illustrates an acoustic tube, according to exemplary embodiments.

FIG. 18 illustrates an acoustic tube 180, according to exemplary embodiments. Here the electrical enclosure 92 (formed by the cover 58 and the housing 90) is shown in hidden view (along with the aperture 152) to illustratively emphasize the acoustic tube 180. There may be many situations in which the internal electrical componentry of the electrical light switch 20 (such as the internal switch assembly 94) may restrict the physical locations for the microphone 52 (such as the sensory element 56 and/or the microphone circuitry 70). The acoustic aperture 100 may act as an acoustic inlet 182 to the acoustic tube 180. The acoustic tube 180 has a length, shape, and configuration that extends from the inner surface 158 (illustrated in FIGS. 12-16) of the cover 58 to the sensory element 56 housed within the electrical enclosure 92. The acoustic tube 180 may have one or more straight sections, bends, and/or curves that snake or route through the internal componentry of the electrical light switch 20 to the sensory element 56 and/or the microphone circuitry 70. The acoustic tube 180 may thus be an acoustic waveguide that reflects and directs the sound pressure waves 54 around and/or through internal switch assembly 94 to the sensory element 56. The acoustic tube 180 may thus have an inner tubular wall 184 defining any cross-sectional shape or area. For simplicity, FIG. 18 illustrates a circular cross-section that aligns with or mates with the acoustic aperture 100. The sensory element 56 may thus be physically located at any position or location within the electrical enclosure 92 formed by the cover 58 and the housing 90. The acoustic tube 180 directs the sound pressure waves 54 (illustrated in FIGS. 2 & 3) to the sensory element 56, regardless of its location within the electrical light switch 20. The acoustic tube 180 may have a cross-sectional shape, diameter, length, and routing to suit any design need or packaging limitation.

Figure 19:
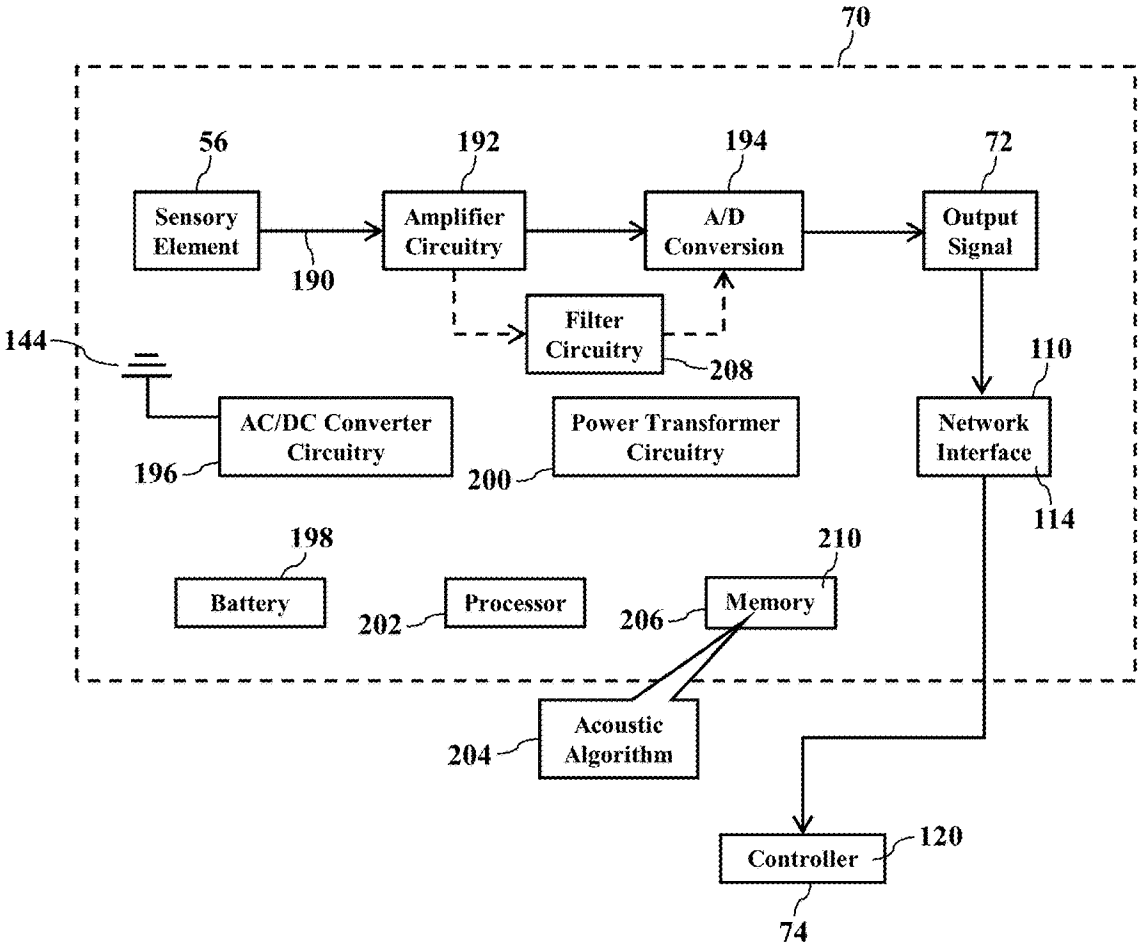
FIG. 19 is a block diagram of microphone circuitry, according to exemplary embodiments.
Figure 20:
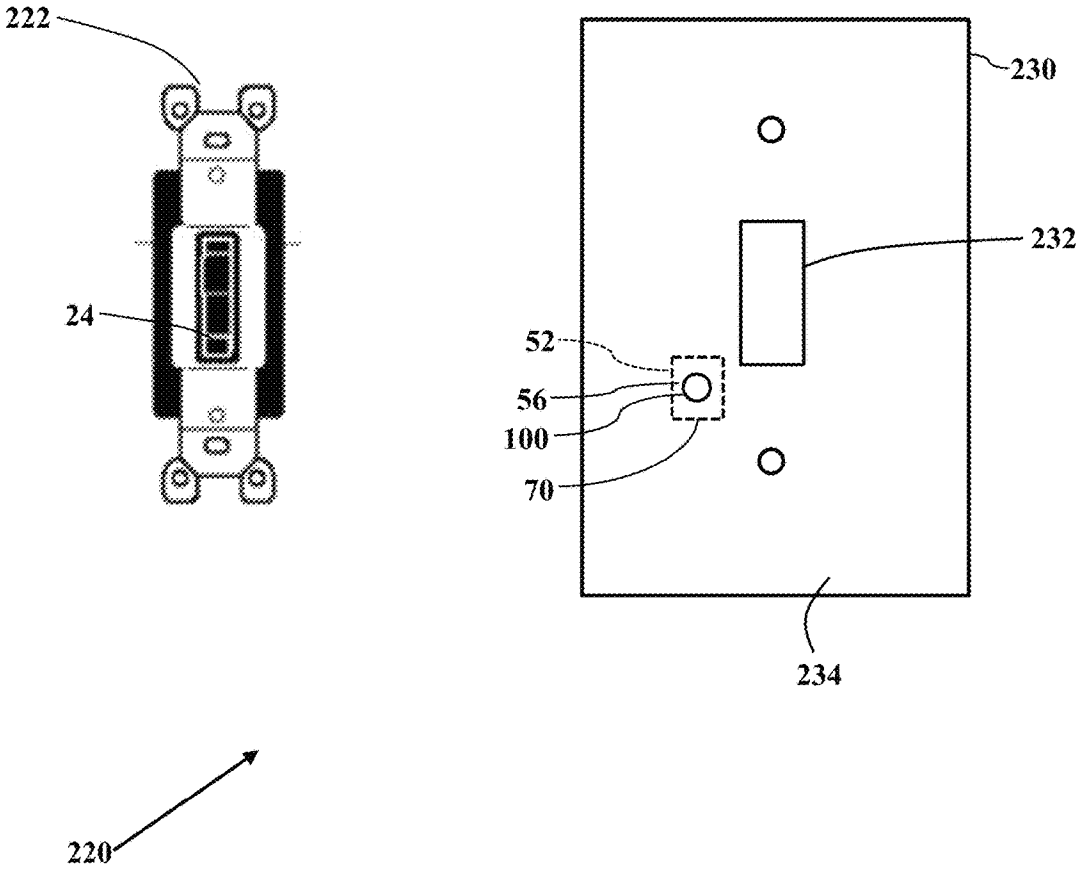
FIGS. 20-23 illustrate retrofit options, according to exemplary embodiments.

FIG. 19 is a block diagram of the microphone circuitry 70, according to exemplary embodiments. There are many different microphone designs and circuits, so FIG. 19 only illustrates the basic components. The sensory element 56 detects audible words and phrases spoken by a user when in the vicinity or proximity of the electrical light switch (as illustrated by FIG. 3). The sensory element 56 converts the sound pressure waves 54 (illustrated in FIGS. 2 & 3) into electrical energy 190 having a current, voltage, and/or frequency. An output of the sensory element 56 may be small, so amplifier circuitry 192 may be used. If the sensory element 56 produces an analog output, an analog-to-digital converter 194 may then be used to convert an output of the amplifier circuitry 192 to a digital form or signal. The microphone circuitry 70 thus generates the output signal 72 that is representative of the sound pressure waves 54. The output signals 72 are received by the network interface 110 and prepared or processed according to the protocol 114. The network interface 110, for example, may wirelessly send the output signals 72 using a cellular, WI-FI®, or BLUETOOTH® protocol or standard. However, the network interface 110 may module the output signals 72 according to power line communications ("PLC") protocol or standard. Regardless, the network interface 110 addresses the output signals 72 to any destination, such as the network address 120 associated with the controller 74. The controller 74 thus interprets the output signals 72 for voice recognition and/or automated control.

Exemplary embodiments may also include power conversion. As the reader may realize, the electrical light switch 20 receives alternating current ("AC") electrical power (current and voltage). The microphone circuitry 70, though, may require direct current ("DC") electrical power. The microphone circuitry 70 may thus include an AC/DC converter circuitry 196 that converts the alternating current electrical power (supplied to the electrical terminal screws 96, 98 and/or 140 of FIGS. 10-11) into direct current electrical power. The direct current electrical power is thus distributed to the sensory element 56 and to the microphone circuitry 70. The microphone circuitry 70 may further include an auxiliary power source (such as an internal power battery 198 or capacitor) for continued operation when the alternating current ("AC") electrical power is not available.

Exemplary embodiments may also include power transformation. The alternating current electrical power provided by the electrical wiring distribution system 22 may be at a different voltage that required by the microphone circuitry 70. For example, in North America the electrical grid delivers 120 Volts AC at 60 Hz. The microphone circuitry 70, though, may require 5 Volts DC or even less. Power transformer circuitry 200 may thus be included to transform electrical power to a desired driver voltage and/or current.

Exemplary embodiments may utilize any microphone technology. Some microphones have a vibrating diaphragm. Some microphones are directional and others are omnidirectional. Different microphone designs have different frequency response characteristics and different impedance characteristics. Some microphones are even manufactured using micro-electro-mechanical systems (or "MEMS") technology. The microphone technology is mot important, as exemplary embodiments may be utilized with any microphone technology or manufacturing process.

Exemplary embodiments may be processor controlled. The electrical light switch 20 and/or the microphone circuitry 70 may also have a processor 202 (e.g., "μLP"), application specific integrated circuit (ASIC), or other component that executes an acoustic algorithm 204 stored in a memory 206. The acoustic algorithm 204 is a set of programming, code, or instructions that cause the processor 202 to perform operations, such as commanding the sensory element 56, the amplifier circuitry 192, the analog-to-digital converter 196, the power transformer circuitry 200, and/or the network interface 110. Information and/or data may be sent or received as packets of data according to a packet protocol (such as any of the Internet Protocols). The packets of data contain bits or bytes of data describing the contents, or payload, of a message. A header of each packet of data may contain routing information identifying an origination address and/or a destination address.

A connection to the electrical ground 144 is also provided. Because the electrical light switch 20 is physically connected to the conductors 32 of the electrical wiring 34 (as FIG. 1 illustrates), the electrical light switch 20 may have an available physical connection to one of the conductors 32 providing electrical ground 144. Even one of the conductors 32 connected to neutral may provide the electrical ground 144.

The microphone circuitry 70 may optionally include filter circuitry 208. Exemplary embodiments may be tuned or designed for certain ranges or bands of frequencies. For example, the human voice is typically very low frequencies (85-300 Hz). If the electrical light switch 20 is used for voice control, the user will likely not speak commands outside the human voice range of frequencies. Exemplary embodiments may thus ignore, or filter out, frequencies not of interest (such as inaudible frequencies) to save processing capability. The filter circuitry 208 may thus be used to avoid wasting resources on unwanted or undesired frequencies.

The filter circuitry 208 may thus remove mechanical and electrical sounds. As a user manually flips the toggle actuator 24 (illustrated in FIG. 1), the electrical light switch 20 may emit acoustic frequencies that correspond to the mechanical movement of the internal switch assembly 94. These mechanical acoustic frequencies correspond or overlap with the audible frequencies of the human voice. The filter circuitry 208 may thus be tuned to ignore or not process the mechanical acoustic frequencies associated with manual activation or movement of the toggle actuator 24. The memory 206 may thus store an electronic database 210 of frequencies or sounds to be ignored or not processed. The electronic database 210 may thus electronically associate different output signals 72 generated by the microphone circuitry 70 that are automatically not processed nor sent to the controller 74. The acoustic algorithm 204 may thus cause the processor 202 to query the electronic database 210 for any output signal 72. When the electronic database 210 has a matching entry, then the processor 202 may ignore, halt, or cease further processing. The electronic database 210 may thus have electronic database entries associated with electrical and mechanical sounds to be ignored, such as mechanical movement associated with internal switch assembly 94. Moreover, the electronic database 210 may also store entries associated with electrical pops, clicks, and arcs, and other sounds associated with electrical connection and disconnection of the internal switch assembly 94.

Exemplary embodiments may be applied regardless of networking environment. Exemplary embodiments may be easily adapted to networking technologies using cellular, WI-FI®, near field, and/or BLUETOOTH® standards. Exemplary embodiments may be applied to any portion of the electromagnetic spectrum and any signaling standard (such as the IEEE 802 family of standards, GSM/CDMA/TDMA or any cellular standard, and/or the ISM band). Exemplary embodiments may be applied to the radio-frequency domain and/or the Internet Protocol (IP) domain. Exemplary embodiments may be applied to any computing network, such as the Internet (sometimes alternatively known as the "World Wide Web"), an intranet, a local-area network (LAN), and/or a wide-area network (WAN). Exemplary embodiments may be applied regardless of physical componentry, physical configuration, or communications standard(s).

Exemplary embodiments may utilize any processing component, configuration, or system. Any processor could be multiple processors, which could include distributed processors or parallel processors in a single machine or multiple machines. The processor can be used in supporting a virtual processing environment. The processor could include a state machine, application specific integrated circuit (ASIC), programmable gate array (PGA) including a Field PGA, or state machine. When any of the processors execute instructions to perform "operations," this could include the processor performing the operations directly and/or facilitating, directing, or cooperating with another device or component to perform the operations.

FIGS. 20-23 illustrate a retrofit option, according to exemplary embodiments. Even though the electrical light switch 20 provides a useful automation control component, some people may be leery of installation. As the conductors 32 of the electrical wiring distribution system 22 (illustrated in FIG. 1) convey the electrical power 26, there is a concern of electrical shock if improperly installed. Professional, licensed installation will likely be required for most people, which could be expensive.

FIGS. 20-23 thus illustrate a retrofit configuration 220. Here the user need only remove and replace an existing switch plate that finishes the existing light switch 222 already installed in the wall. As the reader understands, the conventional switch plate covers the existing light switch 222 installed in the wall. Here the user need only remove the existing switch plate and install an acoustic switch plate 230, according to exemplary embodiments. The acoustic switch plate 230 includes a conventional toggle or rocker aperture 232 that fits onto or slide over the existing toggle/rocker lever actuator 24. However, the acoustic switch plate 230 also includes the acoustic aperture 100 that exposes the microphone 52. That is, here the microphone 52 (e.g., the sensory element 56 and the microphone circuitry 70) may be integrated into or with a switch plate 234 that finishes the existing light switch 222. The acoustic switch plate 230 thus provides a retrofit option for the user. The user may thus simply install the acoustic switch plate 230 to provide voice control capability to a home or business.

Figure 21:
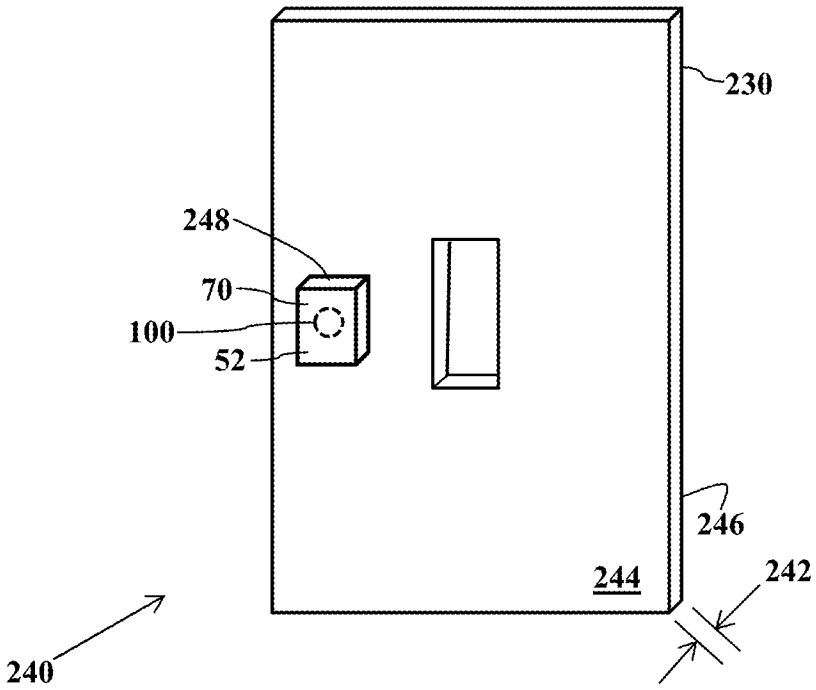

FIG. 21 illustrates a backside 240 of the acoustic switch plate 230. The acoustic aperture 100 extends through a plate thickness 242 defined by an inner surface 244 and a front, outer surface 246. The acoustic aperture 100 has the inner wall 170 defining its cross-sectional area (best illustrated by FIG. 14). The sensory element 56 of the microphone 52 may thus align with the acoustic aperture 100 to detect propagating sounds. The microphone 52 may thus be a small component or chip 248 (such as a MEMS device) that secures to the inner surface 244 of the acoustic switch plate 230. The microphone 52 may thus adhesively adhere to the inner surface 244. The microphone 52 may snap into a molded compartment that acoustically communicates with the acoustic aperture 100. The microphone 52 may even be molded within the plate thickness 242 between the inner surface 244 and the outer surface 246. However the microphone 52 is secured, the sensory element 56 preferably aligns with the acoustic aperture 100 to detect sounds without obstruction when manually moving the toggle/rocker lever actuator 24 (not shown for simplicity).

Figure 22:
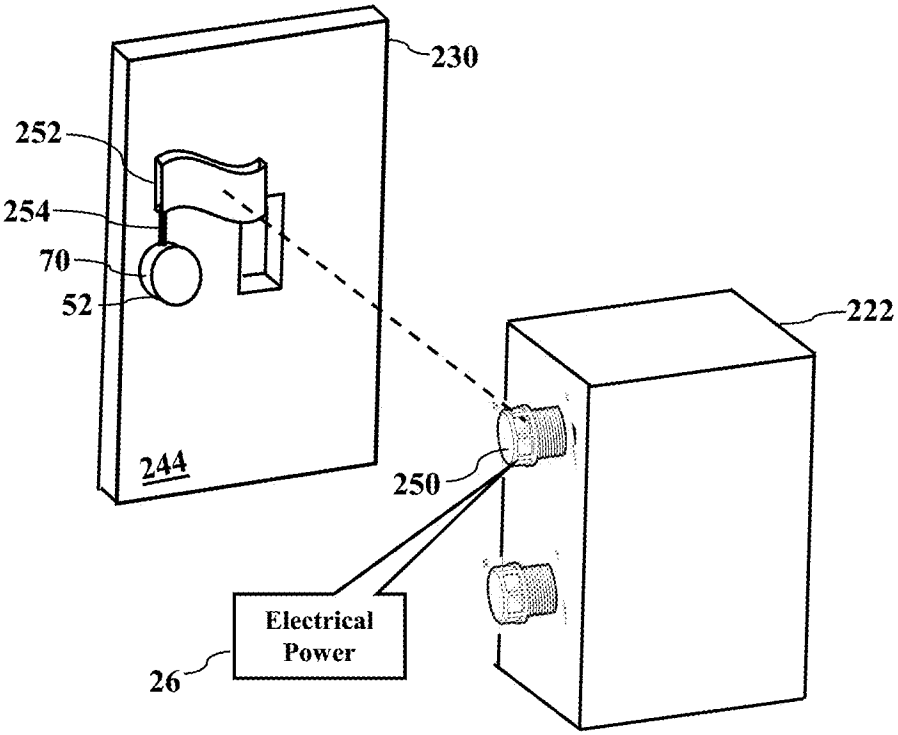

FIG. 22 illustrates an electrical connection. The microphone 52 requires the electrical power 26 for operation. The acoustic switch plate 230 may thus have a means of contacting a "hot" terminal screw 250 in the existing receptacle 222 (already installed in the wall). FIG. 22, for example, illustrates a spring finger 252. The spring finger 252 has an end or portion that is retained to or in the inner surface 244 of the acoustic switch plate 230. The spring finger 252 has an opposite end that contacts the "hot" terminal screw 250 when the acoustic switch plate 230 is installed onto or over the existing receptacle 222. As the acoustic switch plate 230 is installed, the spring finger 252 slides into electrical contact with the terminal screw 250. A line, wire, or via 254 connects the spring finger 252 to the microphone circuitry 70. When the existing receptacle 222 is energized, the spring finger 252 thus supplies or conveys the electrical power 26 from the "hot" terminal screw 250 to the microphone circuitry 70. The microphone circuitry 70 thus receives the electrical power 26 for operation. The acoustic switch plate 230 may thus have multiple spring fingers 252 with each spring finger 252 sliding into contact with a different one of the terminal screws. The multiple spring fingers 252 thus ensure that the microphone circuitry 70 always receives the electrical power 26.

Figure 23:
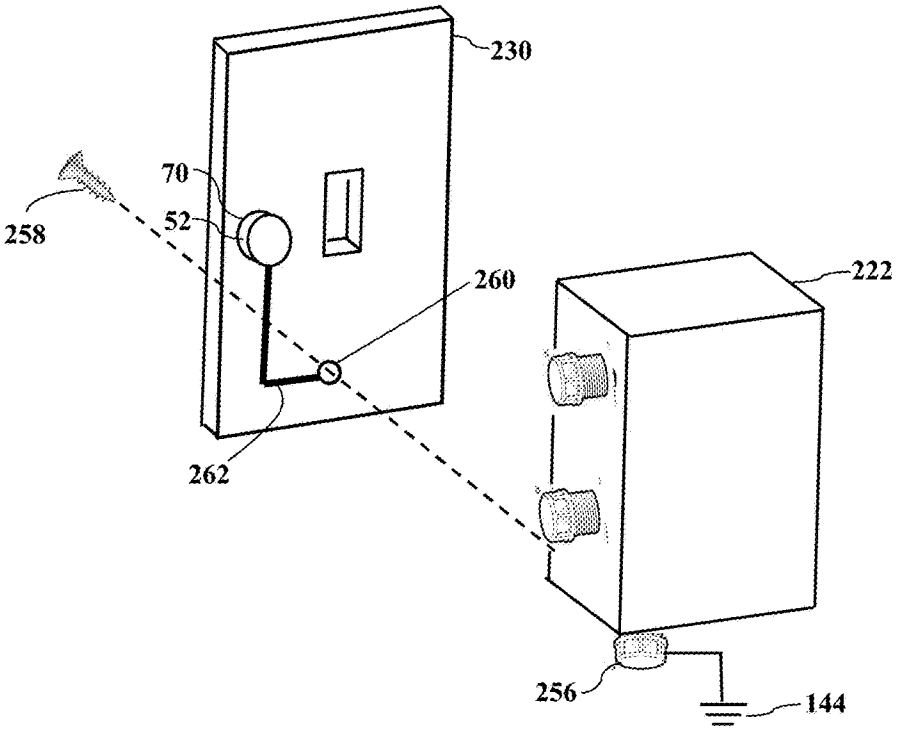

As FIG. 23 illustrates, the connection to the electrical ground 144 is also provided. The existing receptacle 222 may also have a ground terminal screw 256 connected to the electrical ground 144, as is conventional installation. When a mounting screw 258 is installed through a screw hole 260 in the acoustic switch plate 230, the mounting screw 258 makes an electrical connection to the electrical ground 144, as is also conventional installation. The existing receptacle 222 has internal componentry that grounds the mounting screw 258 for safety. Here, though, the acoustic switch plate 230 may have a ground line, wire, or via 262 that electrically connects the mounting screw 258 to the microphone circuitry 70. When the existing receptacle 222 is grounded, the electrical ground 144 is supplied to the microphone circuitry 70.

While the exemplary embodiments have been described with respect to various features, aspects, and embodiments, those skilled and unskilled in the art will recognize the exemplary embodiments are not so limited. Other variations, modifications, and alternative embodiments may be made without departing from the spirit and scope of the exemplary embodiments.

The invention claimed is:

1. An electrical switch, comprising:

a housing retaining an electrical switch assembly therein, the electrical switch assembly having terminal screws adapted for physical connection to conductors supplying voltage of an electrical power distribution system;

a cover mating to the housing, the cover having an aperture exposing a toggle lever for manual actuation of the electrical switch assembly;

a microphone having a sensory element exposed through the cover mating to the housing; and circuitry housed within the housing and having electrical connections to each one of the terminal screws, the circuitry connected to the microphone having the sensory element;

wherein the circuitry receives the voltage when present at any one of the terminal screws for electrically powering the microphone, such that the microphone is electrically powered regardless of a position of the toggle lever.

2. The electrical switch of claim 1, further comprising an acoustic aperture in the cover mating to the housing, the acoustic aperture exposing the sensory element of the microphone.

3. The electrical switch of claim 2, wherein the sensory element of the microphone protrudes through a material thickness of the cover.

4. The electrical switch of claim 1, further comprising a ground connection to electrical ground.

5. The electrical switch of claim 1, further comprising a network interface housed within the housing, the network interface providing an interface to a power-line communications network provided by the conductors of the electrical power distribution system.

6. The electrical switch of claim 1, further comprising a network interface housed within the housing, the network interface providing an interface to a wireless communications network.

7. The electrical switch of claim 1, further comprising filter circuitry housed within the housing, the filter circuitry filtering signals representing inaudible frequencies.

8. An electrical switch, comprising:

a housing retaining an electrical switch assembly therein, the electrical switch assembly having multiple terminal screws adapted for physical connection to conductors energized with voltage and current supplied by an electrical power distribution system;

a cover mating to the housing to form an electrical enclosure, the cover having an aperture exposing a toggle lever of the electrical switch assembly;

an acoustic aperture extending through a material thickness of the cover;

a microphone housed within the electrical enclosure, the microphone having a sensory element exposed by the acoustic aperture in the cover, the sensory element generating an analog signal in response to sound waves; and circuitry housed within the electrical enclosure and having separate electrical connections to each one of the multiple terminal screws;

wherein the circuitry converts the voltage and the current when present on any one of the conductors into direct current electrical power for providing electrical power to the microphone.

9. The electrical switch of claim 8, further comprising a ground connection to electrical ground.

10. The electrical switch of claim 8, further comprising a network interface housed within the electrical enclosure.

11. The electrical switch of claim 10, wherein the network interface interfaces with a wireless communications network.

12. The electrical switch of claim 10, wherein the network interface interfaces with a power-line communications network provided by the conductors of the electrical power distribution system.

13. The electrical switch of claim 8, further comprising amplifier circuitry housed within the electrical enclosure to amplify an output signal generated by the microphone.

* * * * *